US006208321B1

(12) United States Patent
Mizoguchi et al.

(10) Patent No.: US 6,208,321 B1
(45) Date of Patent: Mar. 27, 2001

(54) ELECTROSTATIC INK JET RECORDER HAVING EJECTION ELECTRODES AND AUXILIARY ELECTRODES DIVIDED INTO GROUPS

(75) Inventors: Tadashi Mizoguchi; Hitoshi Takemoto; Junichi Suetsugu; Tomoya Saeki; Hitoshi Minemoto; Kazuo Shima; Yoshihiro Hagiwara; Toru Yakushiji, all of Niigata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/053,578

(22) Filed: Apr. 3, 1998

(30) Foreign Application Priority Data

Apr. 3, 1997 (JP) ..... 9-084870
Apr. 22, 1997 (JP) ..... 9-104945

(51) Int. Cl.[7] ..... B41J 2/06; G03G 15/09
(52) U.S. Cl. ..... 345/55
(58) Field of Search ..... 347/55, 154, 103, 347/123, 111, 159, 127, 128, 17, 120, 151; 399/271, 290, 292, 293, 294, 295

(56) References Cited

U.S. PATENT DOCUMENTS 4,553,150 11/1985 Katahira .
4,794,463 12/1988 Tamura et al. .

FOREIGN PATENT DOCUMENTS 0 761 443 3/1997 (EP) .
0 778 138 6/1997 (EP) .
2 031 344 4/1980 (GB) .
57-11058 1/1982 (JP) .
2-217253 8/1990 (JP) .
6-286130 10/1994 (JP) .
8-1942 1/1996 (JP) .

OTHER PUBLICATIONS

Patent Abstracts of Japan, vol. 009, No. 272, Jun. 22, 1985 (corresponds to JPA 60–116458).

*Primary Examiner*—John Barlow
*Assistant Examiner*—Raquel Yvette Gordon
(74) *Attorney, Agent, or Firm*—Sughrue, Mion, Zinn, Macpeak & Seas, PLLC

(57) ABSTRACT

An electrostatic ink jet recorder of the type controlling charged toner particles contained in ink by using electrophoresis is disclosed. The recorder achieves a miniature and cost-effective configuration by reducing the number of drivers for driving ejection electrodes and auxiliary electrodes. The same amount of toner particles is ejected from all of ejection electrodes despite a scatter in the ejection electrode and a scatter in the position of the ejection electrode relative to auxiliary electrodes and a counter electrode.

14 Claims, 13 Drawing Sheets

ELECTROSTATIC INK JET RECORDER HAVING EJECTION ELECTRODES AND AUXILIARY ELECTRODES DIVIDED INTO GROUPS

BACKGROUND OF THE INVENTION

The present invention relates to an electrostatic ink jet recorder and, more particularly, to an electrostatic ink jet recorder of the type controlling charged toner particles contained in ink by using electrophoresis.

An electrostatic ink jet recorder of the type subjecting ink containing charged toner particles to an electric field and ejecting the ink toward a recording medium on the basis of a Coulomb force acting on the particles is conventional. An ink jet recorder of this type includes an electrophoresis electrode for causing the toner particles to gather at ejection ports due to electrophoresis. A plurality of ejection electrodes each ejects the particles gathering at the associated ejection port. A counter electrode is located at the rear of the recording medium while facing the ejection ports. Auxiliary electrodes are so arranged as to intensify electric fields around the ejection electrodes.

The conventional recorder of the type described has the following problems (1) and (2) left unsolved.

(1) Circuitry for driving the ejection electrodes and auxiliary electrodes is scaled up. Specifically, a single driver must be assigned to each ejection electrode, and a single driver must be assigned to each two auxiliary electrodes. It follows that a multielement head having e.g., electrodes arranged in several ten arrays or a line head having electrodes arranged in several hundred to several thousand arrays needs a prohibitive number of drivers, scaling up drive circuitry. Moreover, an increase in the number of drivers increases the overall size and production cost of the recorder.

(2) Even when the same voltage is applied the ejection electrodes, the amount of toner particles ejected differs from one ejection electrode to another ejection electrode, resulting in dots each having a different shape on a recording medium. This is ascribable to scatters ascribable to the head production process, e.g., scatters in the configuration of the ejection electrodes and ejection ports, the position of the auxiliary electrodes relative to the ejection electrodes, and the distance between the ejection electrodes and the counter electrode. The ejection electrodes, for example, promote the concentration of electric fields more positively when provided with sharper tips, increasing the amount of particles to be ejected and the size of a dot on the recording medium. As the distance between a given ejection electrode and the associated auxiliary electrode or the counter electrode decreases, compared to the distance between another ejection electrode and the associated auxiliary electrode or the counter electrode, the size of a dot on the recording medium increases, and vice versa. Such a scatter in dot size is aggravated when the number of ejection electrodes is increased.

Technologies relating to the present invention are also taught in, e.g., Japanese Patent Laid-Open Publication Nos. 57-11058, 2-217253, 6-286130, and 8-1942.

SUMMARY OF THE INVENTION

It is therefore a first object of the present invention to solved the above problem (1), i.e., to provide a miniature cost-effective electrostatic ink jet recorder by reducing the number of drivers for driving ejection electrodes and auxiliary electrodes.

It is a second object of the present invention to solve the problem (2), i.e., to provide an electrostatic ink jet recorder capable of ejecting substantially the same amount of toner particles from all of its ejection electrodes despite a scatter in the ejection electrode and a scatter in the position of the ejection electrodes relative to auxiliary electrodes and a counter electrode.

In accordance with the present invention, an electrostatic ink jet recorder for recording an image on a recording medium by applying an electric field to ink containing charged toner particles and ejecting an ink drop based on a Coulomb force acting on the toner particles includes an electrophoresis electrode for causing the toner particles to concentrate at ejection ports. A plurality of ejection electrodes each ejects the toner particles concentrating at particular one of the ejection ports. A counter electrode faces the ejection ports with the intermediary of the recording medium. A plurality of auxiliary electrodes adjoin the plurality of ejection electrodes for intensifying electric fields. The ejection electrodes are divided into a plurality of groups and applied with a voltage group by group. The auxiliary electrodes are also divided into a plurality of groups and applied with a voltage group by group.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

The problem (1) will be discussed more specifically in order to better understand embodiments of the present invention capable of solving it, i.e., achieving the first object of the present invention.

Figure 1:
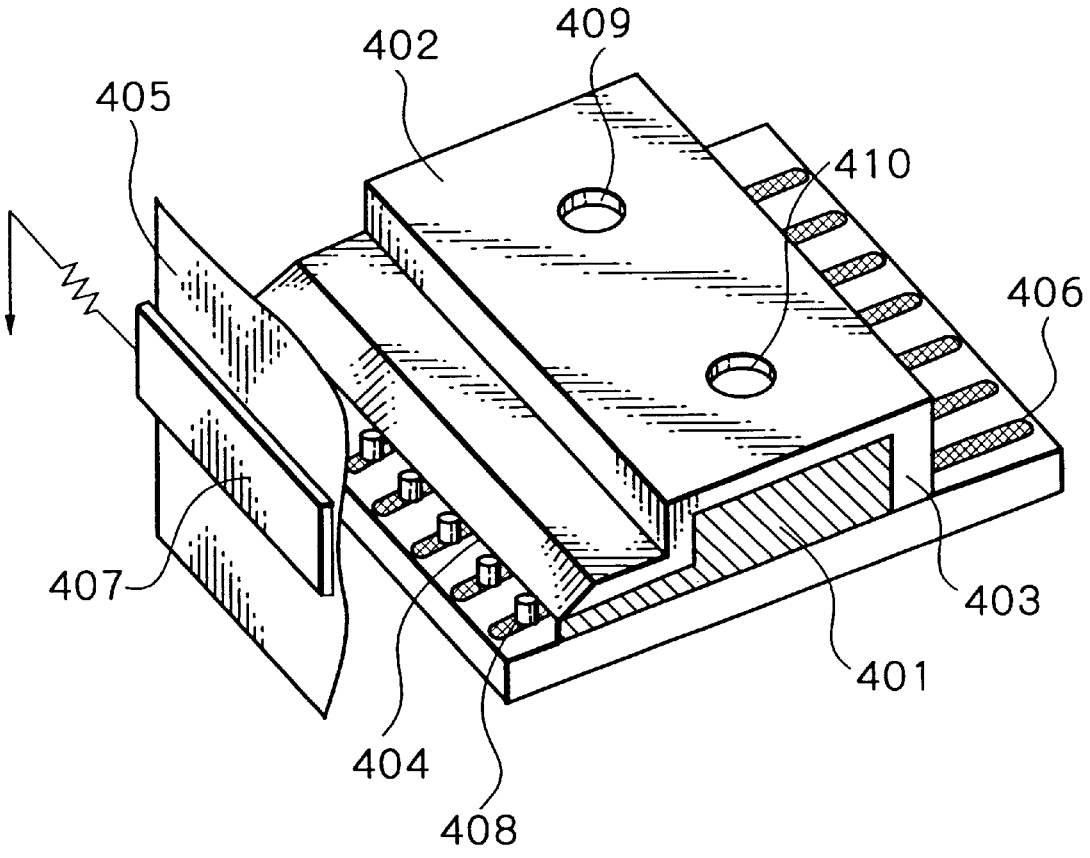
Fig. 1 PRIOR ART
FIG. 1 is a perspective view showing a head included in a conventional electrostatic ink jet recorder and arrangements surrounding it.
Figure 2:
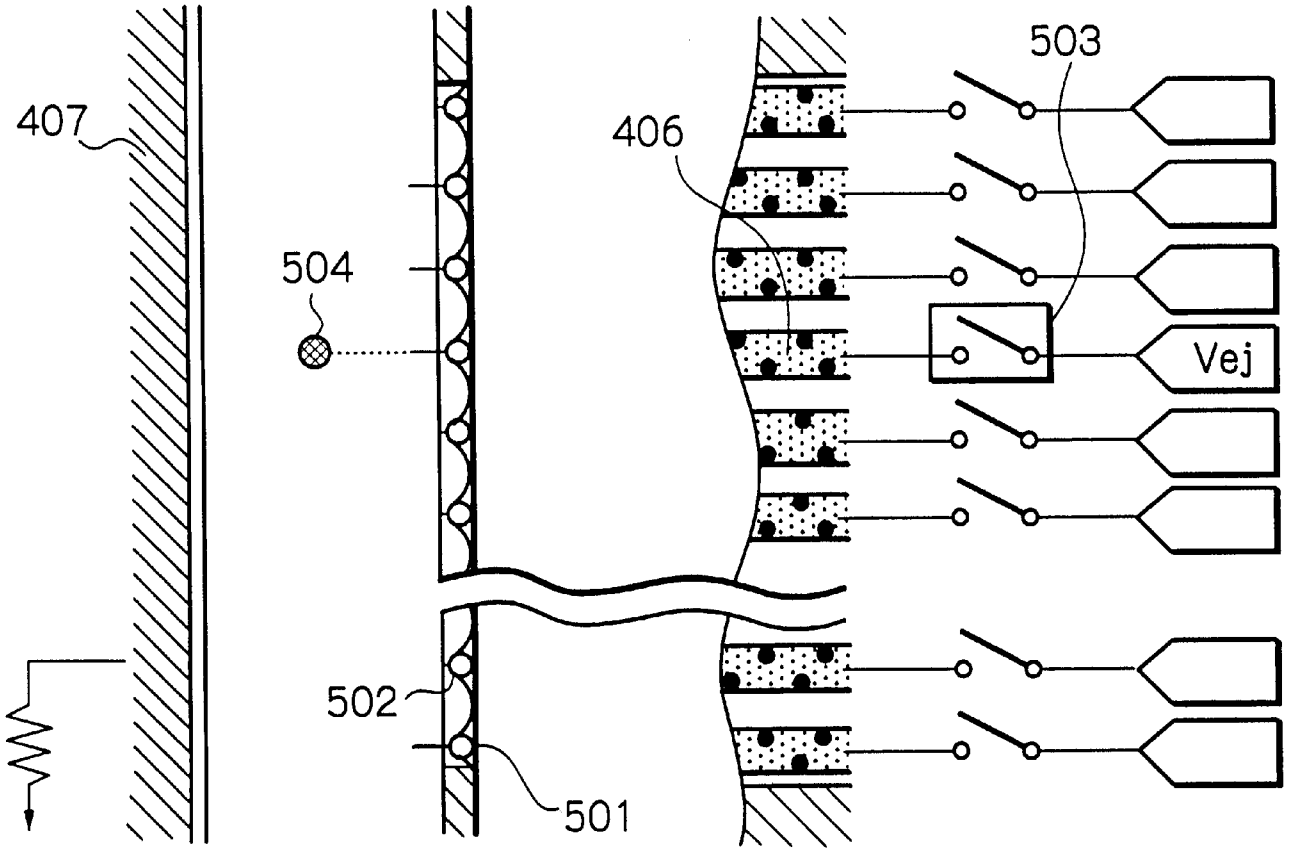
Fig. 2 PRIOR ART
FIG. 2 is a plan view of the head of FIG. 1 and the arrangements surrounding it.

As shown in FIGS. 1 and 2, a conventional electrostatic ink jet recorder includes an ink chamber 402 filled with ink 401 containing toner particles 501. An electrophoresis electrode 403 causes the toner particles 501 to gather at ejection ports 404. A plurality of ejection electrodes 406 jet the toner particles 501 gathering at the ejection ports 404 toward a recording medium 405. A counter electrode 407 is positioned at the rear of a recording medium 405 while facing the ejection electrodes 406. The ejection ports 404 are partitioned from each other by walls 408 on an ejection electrode basis such that the ink 401 forms a convex meniscus 502 at the tip of each ejection electrode 406. The ink chamber 402 is communicated to an ink tank, not shown, by tubings, not shown, via an ink inlet 409 and al ink outlet 410. In this condition, a back pressure acts on the ink existing in the ink chamber 402, and the ink 401 is forcibly circulated via the ink chamber 402.

Figure 3:
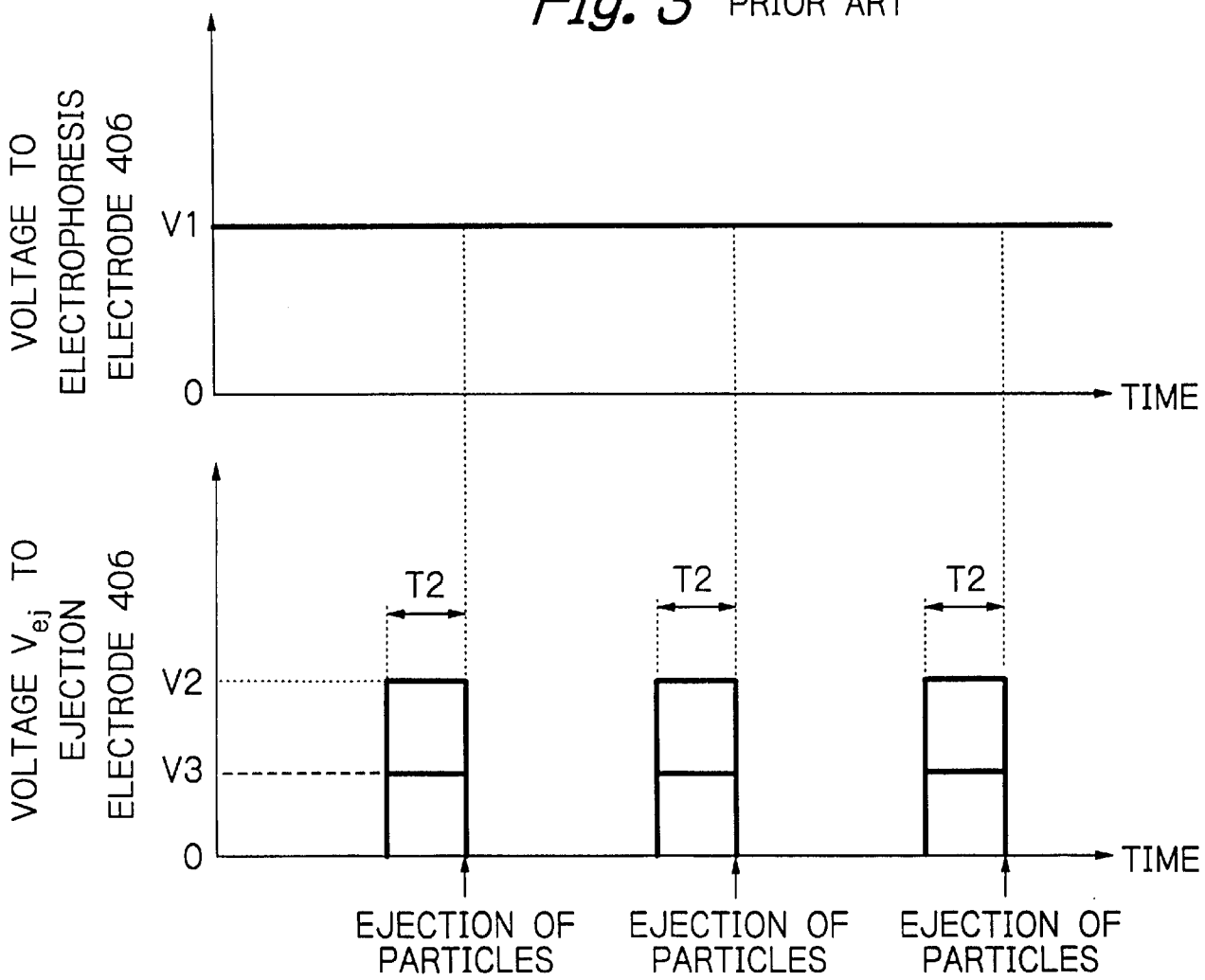
Fig. 3 PRIOR ART
FIG. 3 shows the waveforms of voltages applied to ejection electrodes and an electrophoresis electrode included in the recorder shown in FIG. 1.

Electrophoresis used by the above ink jet recorder is such that when charged toner particles are subjected to an electric field, they migrate in one direction under the electric field. Specifically, as shown in FIG. 3, assume that a preselected voltage V1 is applied to the electrophoresis electrode 403. Then, the toner particles 501 of the ink 401 migrate toward the ejection ports 404 at a given electrophoretic velocity.

More specifically, assume that one of drivers 503, FIG. 3. for ejecting the particles 501 is turned on in order to apply a voltage V2 shown in FIG. 3, i.e., a pulse-like ejection electrode voltage Vej to the associated ejection electrode 406. Then, a static electric field is formed between the ejection electrode 406 and the counter electrode 407. As a result, the particles 501 migrate toward and gather at the tip of the electrode 406. Such particles 501 overcome the surface tension, viscosity and so forth of the ink 401 due to the electrostatic force. Consequently, the particles 501 fly away from the electrode 406 in the form of a fine mass of particles, or drop, 504 at a timing synchronous with the pulse-like voltage Vej, as shown in FIG. 2. The drop 504 deposits on the recording medium 405. Subsequently, ink is fed to the ink chamber 402 via the ink inlet 409 in order to replenish the particles 501.

The above operation is repeated until a desired image has been formed on the recording medium 405.

Figure 4:
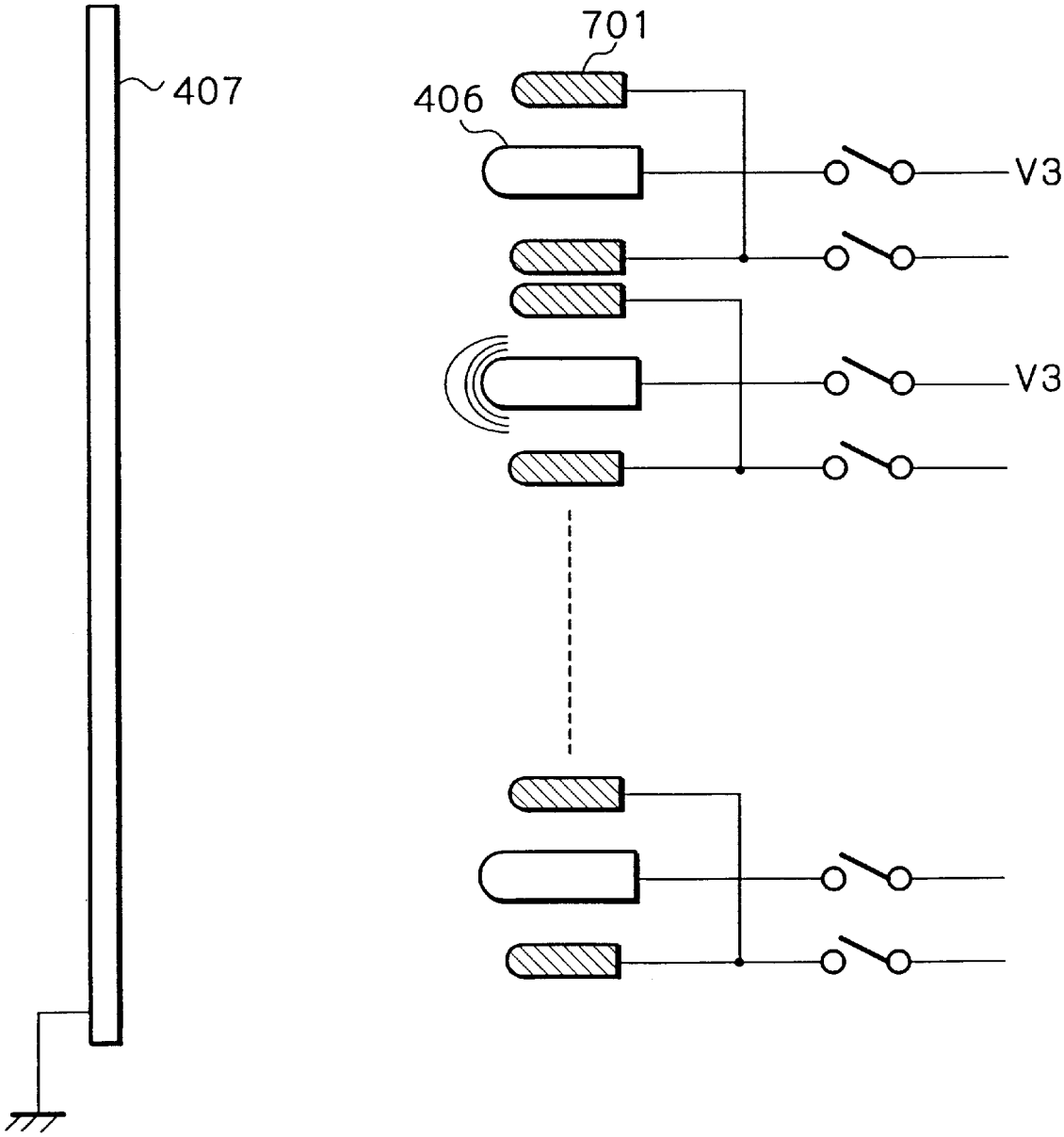
Fig. 4 PRIOR ART
FIG. 4 shows the arrangement of auxiliary electrodes also included in the recorder of FIG. 1 for concentrating electric fields.

Generally, the voltage Vej applied to each ejection electrode 406, as stated above, is as high as about 1,000 V. FIG. 4 shows auxiliary electrodes 701 customarily arranged around the discharge electrodes 406 in order to reduce the voltage to be applied to the electrodes 406. Specifically, whether or not the drop 504 flies depends on the size of the electric field of the individual ejection electrode 406. The auxiliary electrodes 701 are therefore used to intensity the electric field around the individual discharge electrode 406 toward the counter electrode 407.

However, the conventional ink jet recorder with the above construction has the problem (1) stated previously.

A first and a second embodiment the electrostatic ink jet recorder in accordance with the present invention each is a solution to the problem (1), as follows.

1st Embodiment

Figure 5:
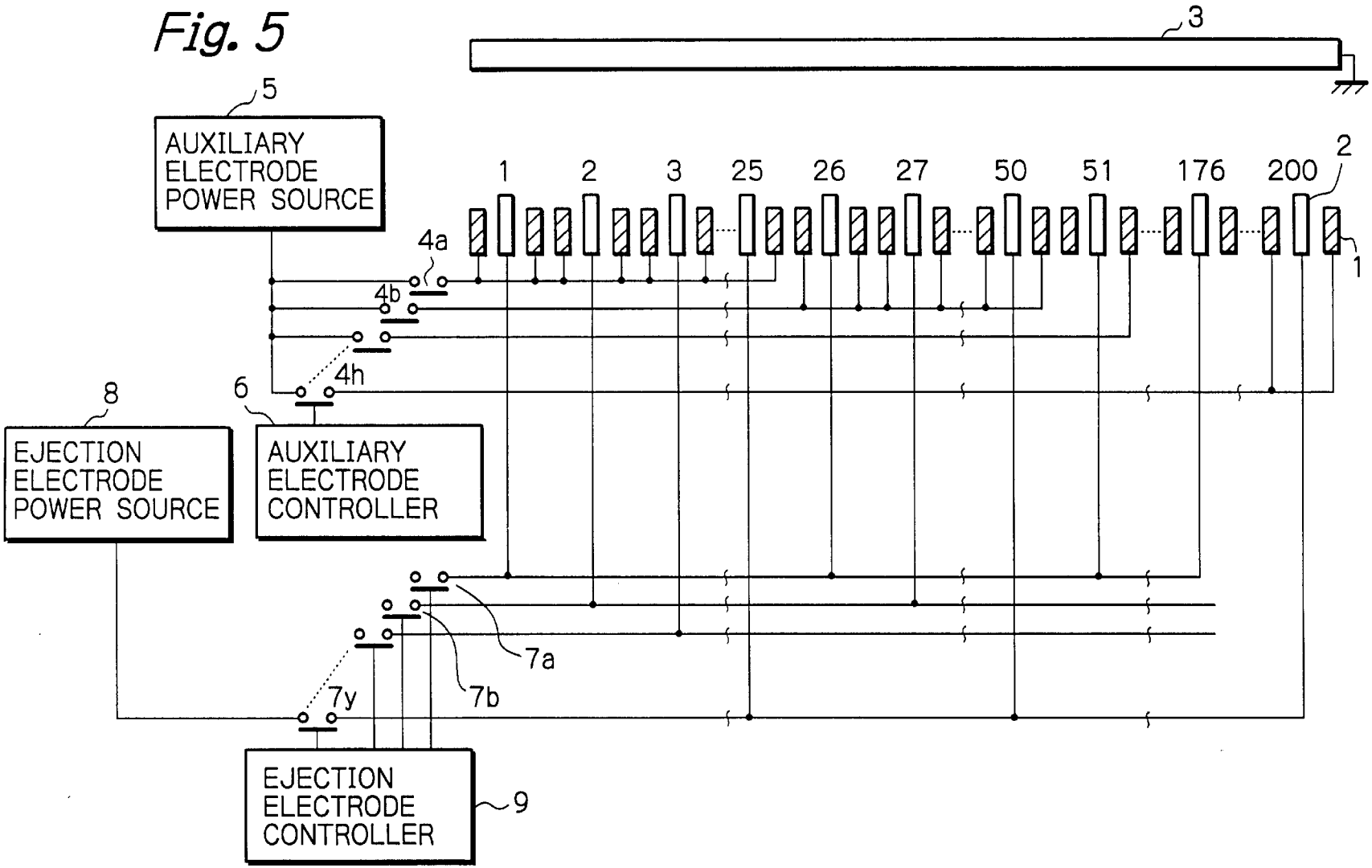
FIG. 5 shows control means included in a first embodiment of the electrostatic ink jet recorder in accordance with the present invention for controlling ejection electrodes and auxiliary electrodes.
Figure 6:
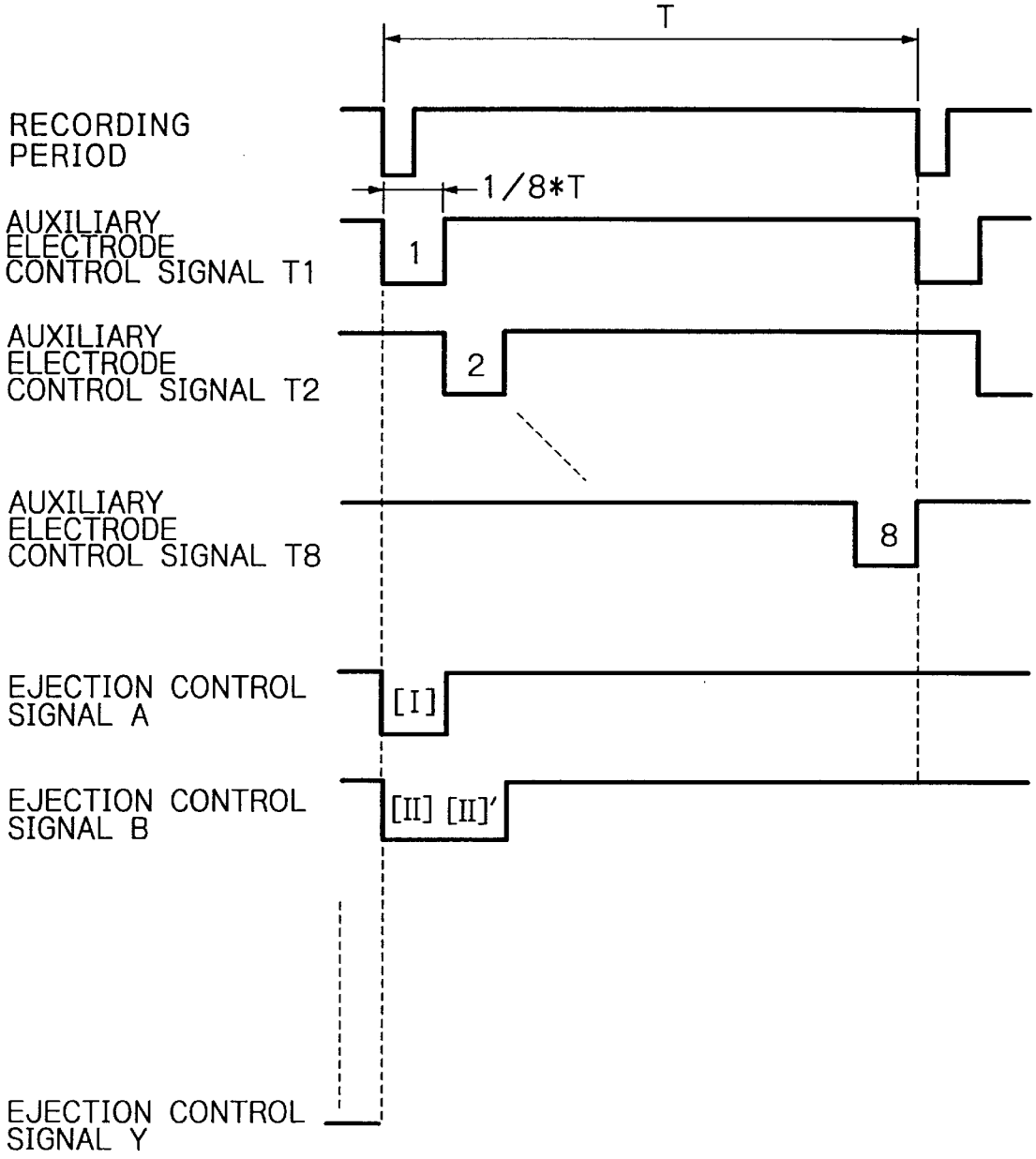
FIG. 6 shows the waveforms of voltages applied to the ejection electrodes and auxiliary electrodes of the first embodiment.

Referring to FIGS. 5 and 6, an electrostatic ink jet recorder embodying the present invention will be described. FIG. 5 shows head drive means including ejection electrode control means and auxiliary electrode control means for promoting the concentration of electric fields. FIG. 6 shows the waveforms of voltages applied to ejection electrodes and auxiliary electrodes. The illustrative embodiment is assumed to include a multielement head having 200 ejection electrodes.

As shown in FIG. 5, the auxiliary electrode control means includes auxiliary electrodes 1 for promoting the concentration of electric fields. Let the auxiliary electrodes 1 be serially numbered from 1 through 200, although not shown specifically. In the illustrative embodiment, each twenty-five consecutive auxiliary electrodes 1 constitute a single group as follows. The auxiliary electrodes #1-#25 constitute a first group while the auxiliary electrodes #26-#50 constitute a second group. In the same manner, the auxiliary electrodes #176-#200 constitute an eighth group. The auxiliary electrodes 1 of each group are connected by the same signal line. The first group is connected to an auxiliary driver 4*a* which is in turn, connected to an auxiliary electrode power source 5. Likewise, the second to eighth groups are respectively connected to auxiliary drivers 4*b*–4*h* which are also connected to the auxiliary electrode power source 5. An auxiliary electrode controller 6 selectively turns on or turns off switches included in the drivers 4*a*–4*h* so as to set up or interrupt voltage application to the auxiliary electrodes 1.

The ejection electrode control means includes ejection electrodes 2. Let the ejection electrodes 2 be also serially numbered from 1 through 200, as shown in FIG. 5. In the illustrative embodiment, the ejection electrodes 2 located at every twenty-fifth position constitute a single group. Specifically, the ejection electrodes #1, #26, . . . , #176 constitute a first group while the ejection electrodes #2, #27, . . . , #127 constitute a second group. In the same manner, the ejection electrodes #25, . . . , 200 constitute a twenty-fifth group. The electrodes 2 belonging to each group are connected by the same signal line. The first group is connected to an ejection driver 7*a* which is, in turn, connected to an ejection electrode power source 8. Likewise, the second to twenty-fifth groups are respectively connected to ejection drivers 7*b*–7*y* which are also connected to the ejection electrode power source 8. An ejection electrode controller 9 selectively turns on or turns off switches included in the ejection drivers 7*a*–7*y* so as to set up or interrupt voltage application to the electrodes 2.

How toner particles are ejected from the ejection electrodes 2 will be described with reference to FIG. 6. As shown, the auxiliary electrode controller 6 sequentially feeds auxiliary control signals T1–T8 to the eight auxiliary drivers 4*a*–4*h*, respectively. The signals T1–T8 are produced by equally dividing a single recording period T into eight with respect to time. Therefore, while the auxiliary control signal T1 fed to the auxiliary driver 4*a* is in its ON state (labeled 1 in FIG. 1; a period of time of ⅛×T), an auxiliary electrode voltage for concentrating an electric field is applied to the auxiliary electrodes #1-#25 belonging to the first group. Likewise, the auxiliary electrode is sequentially applied to the second group of auxiliary electrodes to the eighth group of auxiliary electrodes for a duration of ⅛×T each.

The ejection electrode controller 9 selectively turns on or turns off the ejection drivers 7*a*–7*y* by synchronizing a signal output from an image control section, not shown, to the auxiliary control signals, thereby applying a voltage to the ejection electrodes 2. For example, when the controller 9 receives an ejection command representative of image data on the ejection electrode #1, the controller 9 outputs, via an ejection control signal A, a signal for turning on the ejection driver 7*a* in synchronism with the auxiliary control signal T1 (labeled [I]). As a result, the auxiliary electrode voltage is applied to the first group of auxiliary electrodes, generating an electrode intense enough to eject toner particles at the ejection electrode #1.

To eject toner particles from the ejection electrode #2, the ejection electrode controller 9 outputs, via an ejection control signal B, a signal for turning on the ejection driver 7*b* in synchronism with the auxiliary control signal T1 (labeled [II]). Likewise, to eject toner particles from the ejection electrode #27, the ejection electrode controller 9 outputs, via the control signal B, a signal for turning on the ejection driver 7*b* in synchronism with the auxiliary control signal T2 (labeled [II]). In this manner, then toner particles should be ejected from any one of the ejection electrodes 2 designated by image data, an ejection control signal assigned to the discharge electrode 2 is turned on in synchronism with the auxiliary control signal.

2nd Embodiment

Figure 7:
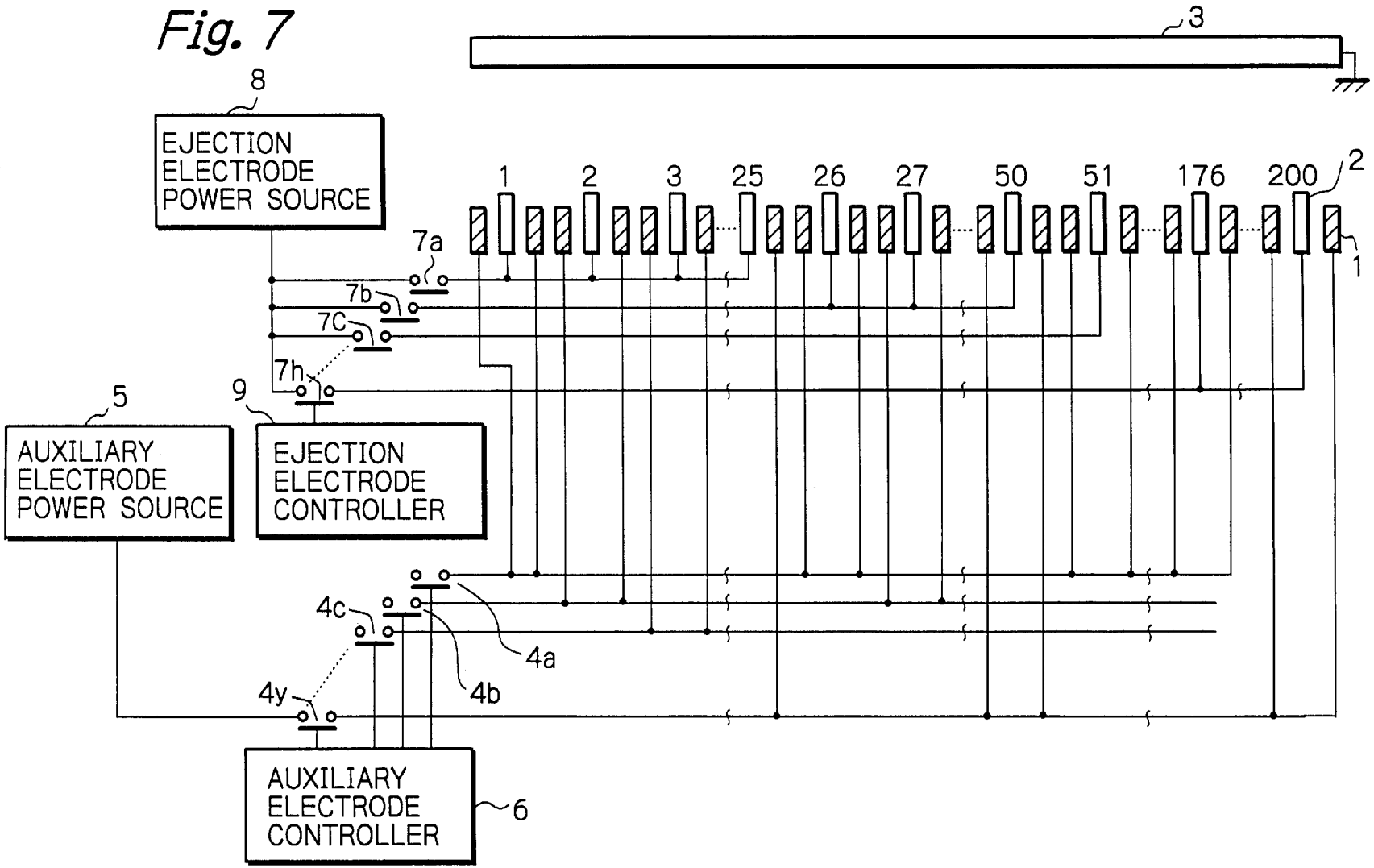
FIG. 7 shows control means representative of a second embodiment of the present invention.

A second embodiment of the present invention is shown in FIG. 7 and also includes a multielement head having 200 ejection electrodes. As shown, in this embodiment, each twenty-five consecutive ejection electrodes 2 constitute a single group. That is, the electrodes 2 are divided into a first group having the ejection electrodes #1, #2, #3, . . . , #25, a second group having the ejection electrode #26, . . . , #50, and so forth. An eighth group has the ejection electrodes #176, . . . , #200. On the other hand, the auxiliary electrodes 1 located at every twenty-fifth position constitute a single group. Specifically, a first group has the auxiliary electrodes #1, #26, #51, . . . , #176, and a second group has auxiliary electrodes #2, #27, . . . , #177. The last or twenty-fifth group has the auxiliary electrodes #25, . . . , #200. When voltages are applied to any one of the ejection electrodes 2 and auxiliary electrodes 1 associated therewith at the same time, toner particles are ejected from the ejection electrode 2, as in the previous embodiment. The illustrative embodiment reduces the required number of ejection drivers from 25 to 8, compared to the first embodiment. This is desirable from the cost standpoint because the ejection drivers turn on and turn off a higher voltage than the auxiliary drivers and are therefore more expensive.

With a multielement head having 200 ejection electrodes and auxiliary electrodes associated therewith, it has been customary to assign a single driver to each ejection electrode and a single driver to each two auxiliary electrodes, resulting in 400 drivers in total. By contrast, the first and second embodiments each is capable of driving the ejection electrodes and auxiliary electrodes with thirty-three drivers, i.e., 8+25=33. To further reduce the number of drivers, the auxiliary drivers and ejection drivers may be suitably combined, e.g., 16+13=29. In addition, a combination implementing the lowest production cost may be selected.

As stated above, the first and second embodiments each includes head drive means having ejection electrode control means for applying a voltage to a plurality of ejection electrodes while controlling the electrodes group by group and auxiliary electrode control means for applying a voltage to a plurality of ejection electrodes while controlling the electrode group by group. With such head drive means, it is possible to reduce the number of drivers and therefore to scale down the circuitry. The embodiments therefore each implements a miniature cost-effective ink jet recorder.

Now, the problem (2) stated earlier will be discussed more specifically in order to better understand other embodiments of the present invention each of which is a solution to the problem (2).

Figure 8:
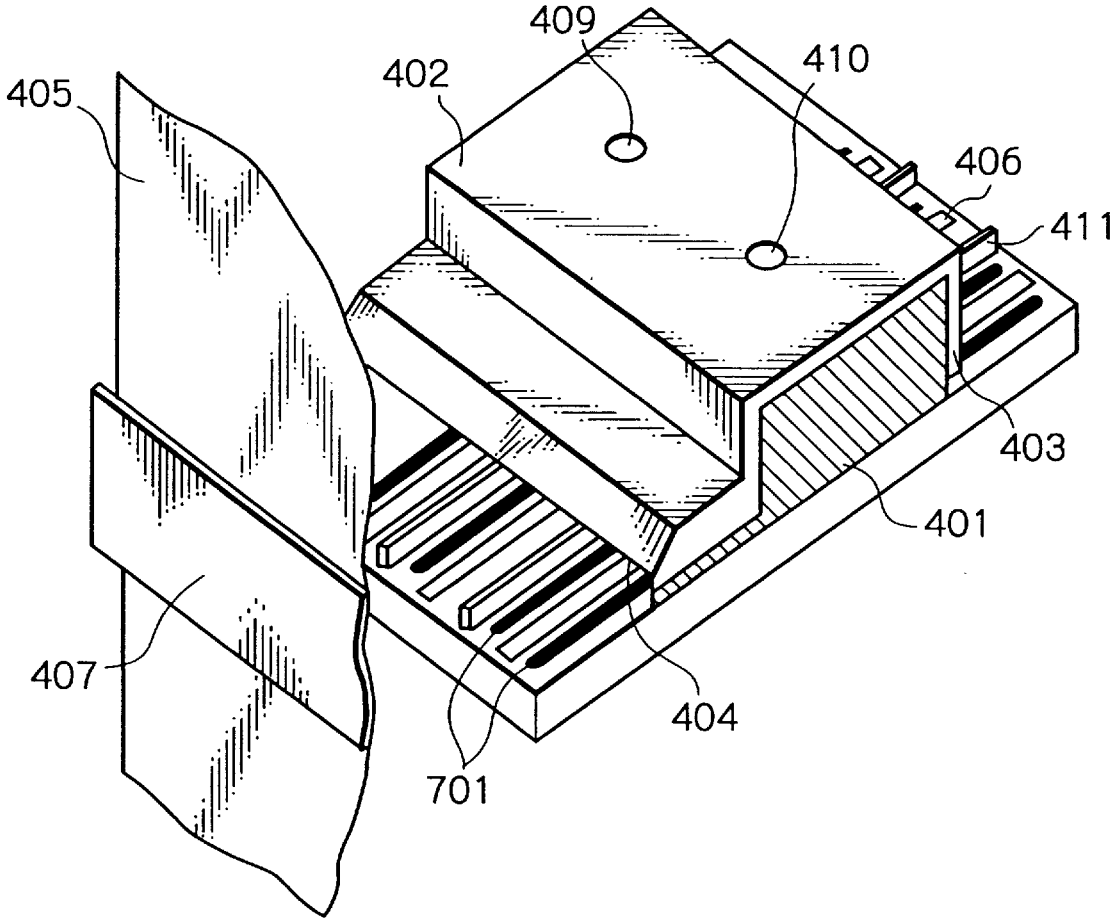
FIG. 8 is a perspective view showing a head included in another conventional electrostatic ink jet recorder together with arrangements surrounding it.
Figure 9:
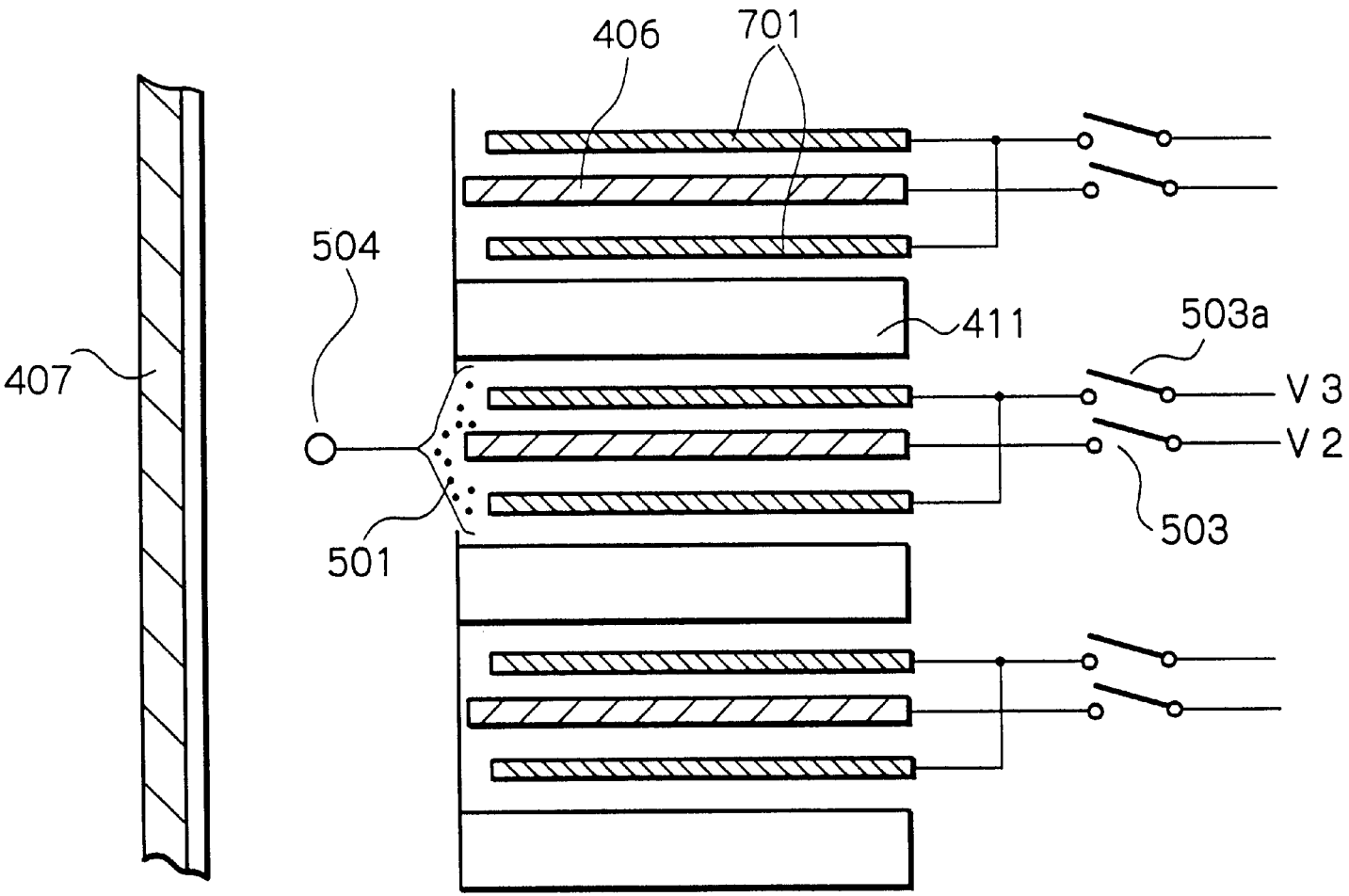
FIG. 9 is a plan view showing the basic configuration of the head and associated arrangements shown in FIG. 8.
Figure 10:
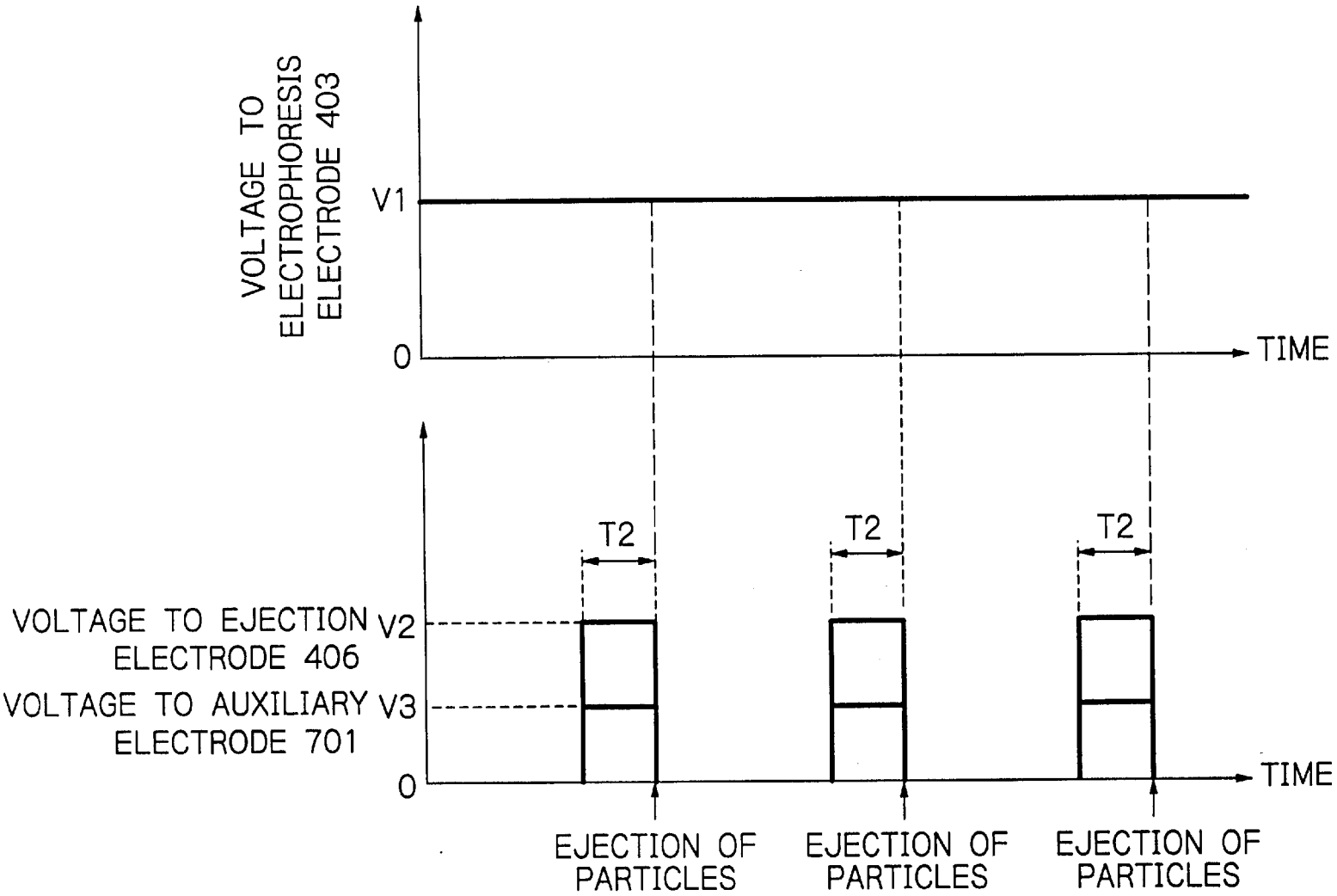
Fig. 10 PRIOR ART
FIG. 10 shows the waveforms of voltages applied to the ejection electrodes and auxiliary electrodes of FIG. 8 as well as the waveform of a voltage applied to an electrophoresis electrode.

FIG. 8 shows another conventional ink jet recorder identical with the conventional recorder of FIG. 1 except that it includes auxiliary electrodes 701 for concentrating electric fields. As shown in FIG. 9, the ejection ports 404 are partitioned by walls 411 on an ejection electrode basis such that the ink 401 forms a convex meniscus at the tip of each ejection electrode 406. The principle of electrophoresis is also applied to this ink jet recorder. FIG. 10 shows a preselected voltage V1 applied to the electrophoresis electrode 403.

As shown in FIG. 9, assume that a driver 503 and a driver 503*a* associated therewith are turned on in order to eject the toner particles 501. The driver 503 feeds a voltage V2, FIG. 10, to the associated ejection electrode 406 for a duration of T2 while the driver 503*a* feeds a pulse voltage V3 to the associated auxiliary electrodes 701 for the duration of T2. As a result, an intense electric field formed between the ejection electrode 406 and the auxiliary electrodes 701 causes the particles 501 to migrate toward and concentrate at the tip of the electrode 406. The auxiliary electrode 701 is so positioned as to intensify the electric field toward the counter electrode 407, serving to reduce the voltage to be applied to the ejection electrode 406.

As shown in FIG. 9, the particles 501 having overcome the surface tension, viscosity and so forth of the ink 401 fly away from the tip of the ejection electrode 406 toward the recording medium 405 in the form of a fine mass or drop. Again, the particles 501 are supplemented by ink fed to the ink chamber 402 via the ink inlet port 409.

The above operation is repeated until an image is formed on the recording medium 405. However, the conventional ink jet recorder having the above configuration has the problem (2).

A third and a fourth embodiment of the present invention capable of solving the problem (2) will be described hereinafter.

3rd Embodiment

Figure 11:
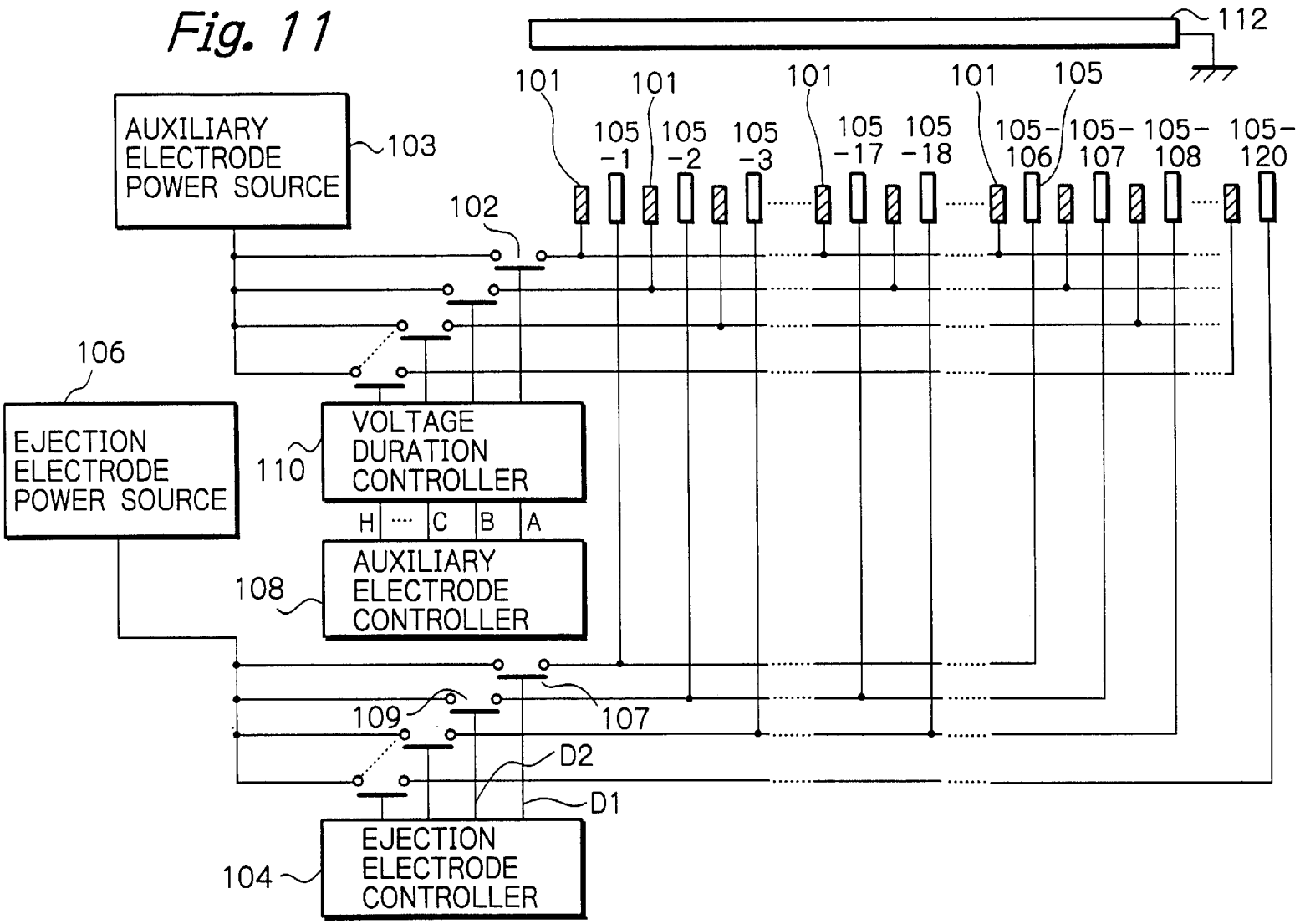
FIG. 11 shows control means representative of a third embodiment of the present invention.
Figure 12:
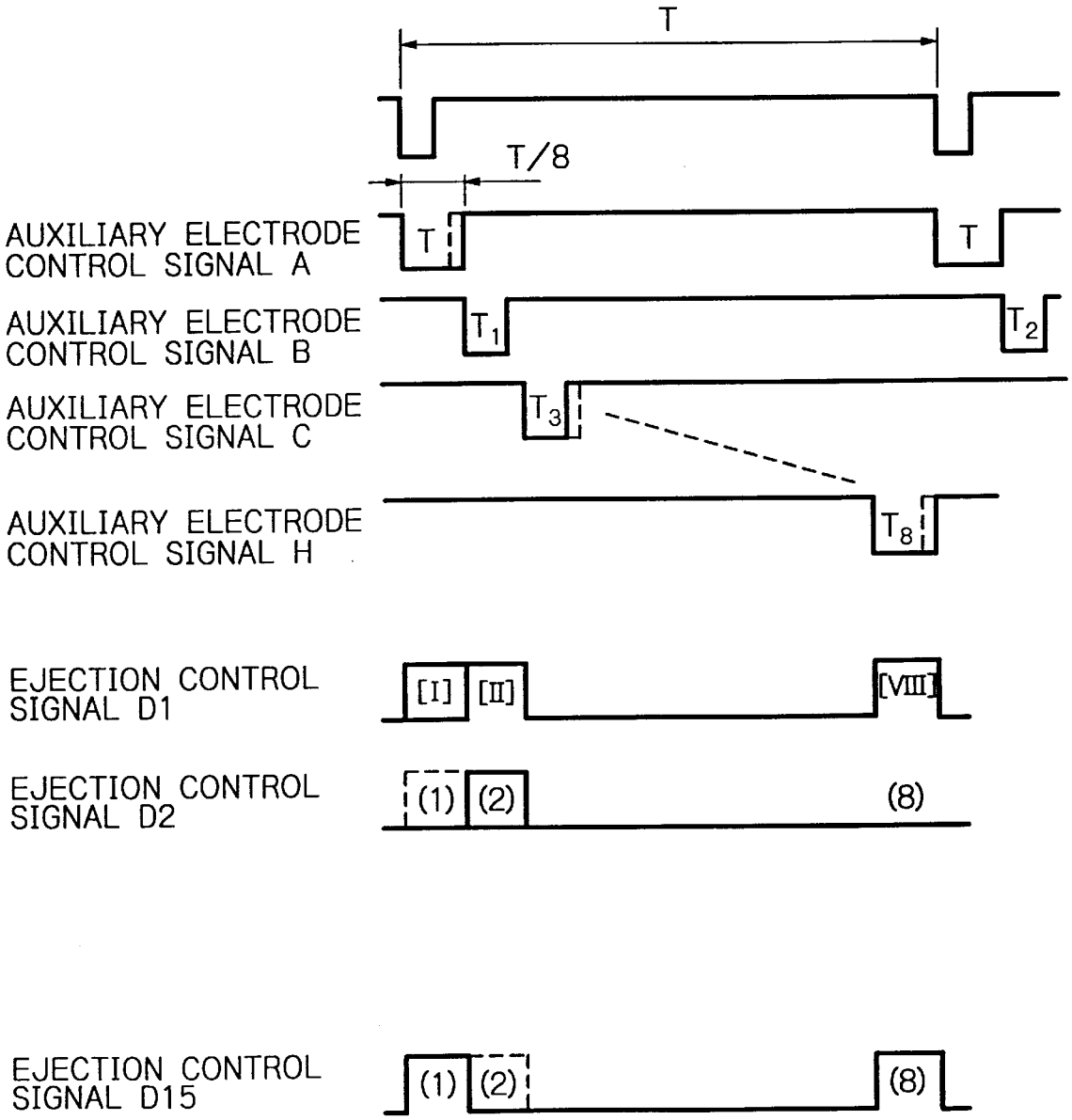
FIG. 12 shows the waveforms of voltages applied to ejection electrodes and an auxiliary electrode included in the third embodiment.

Reference will be made to FIGS. 11 and 12 for describing a third embodiment of the present invention. FIG. 11 shows circuitry similar to the circuitry of the first and second embodiments shown in FIGS. 5 and 7, respectively. FIG. 12 shows the waveforms of voltages similar to the waveforms of FIG. 6. The following description will concentrate on a multielement head having 120 ejection electrodes by way of example. Specifically, this kind of head has fifteen head units each having eight ejection electrodes.

Assume that in a given head unit the distance between a given ejection electrode 105 and an auxiliary electrode 101 associated therewith is not constant due to a scatter ascribable to the production process, and that the amounts of toner particles ejected from the ejection electrode 105 #1 (#105-1 hereinafter; this also applies to the other electrodes) and #105-8 is comparatively small while the amount of particles ejected from the ejection electrode #105-3 is comparatively great. Then, dots formed on a recording medium by the election electrodes #105-1 and #105-8 are small while a dot formed by the ejection electrode #105-3 is large.

Auxiliary electrodes 101 for concentrating electric fields are grouped, as follows. A first auxiliary electrode #101-1 and every eight auxiliary electrodes #101-9, #101-17, . . . , #101-113 constitute a first group while a second auxiliary electrode 101-2 and every eight auxiliary electrodes #101-10, #101-18, . . . , #101-114 constitute a second group. Likewise, an eighth auxiliary electrode #101-8 and every eight auxiliary electrodes #101-16, #101-24, . . . , #101-120 constitute a fifteenth group. In this manner, the auxiliary electrodes 101 are divided into fifteen groups in total. The auxiliary electrodes of each group are connected by the same signal line. The first group of auxiliary electrodes are connected to one end of an auxiliary driver 102 which is, in turn, connected to an auxiliary electrode power source 103. The auxiliary driver 102 is turned on and turned off by an auxiliary electrode controller 108. In this configuration, the output voltage of the power source 103 is fed to each group of auxiliary electrodes via the associated driver 102.

The ejection electrodes 105 are grouped, as follows. A first ejection electrode #105-1 and every fifteen ejection electrodes #105-16, . . . , #105-106 constitute a fist group connected to an election driver 107 which is, in turn, connected to an ejection electrode power source 106. Likewise, a second ejection electrode #105-2 and every fifteenth ejection electrodes #105-17, . . . , #105-107 constitute a second group connected to an ejection driver 109. In this manner, the ejection electrodes 105 are divided into eight groups each being connected to a respective ejection driver. The ejection drivers are turned on and turned off by an election electrode controller 104.

A voltage duration controller 110 controls the duration of the voltage to be applied from the auxiliary electrode power source 103 to the individual auxiliary electrode group. The auxiliary electrode controller 108 sets up and interrupts the application of the output voltage of the power source 103 to each of the eight groups of auxiliary electrodes 101 via the voltage duration controller 110.

FIG. 12 shows voltages applied to a plurality of ejection electrodes and voltages applied to a plurality of auxiliary electrodes. How the toner particles are ejected from the ejection electrodes in substantially the same amount will be described with reference to FIG. 12. As shown, the auxiliary electrode controller 108 sequentially feeds to the eight auxiliary drivers auxiliary electrode control signals A–H produced by equally dividing a single recording period T into eight. The durations of the control signals A–H are controlled by the voltage duration controller 110.

T2, T4, T5 and T6 are a default value. T1 and T8 are longer than the default value while T3 is shorter than the default value; the default value is indicated by a dashed line. While the control signal A is in its ON state (T1), it turns on the auxiliary driver connected to the first group of auxiliary electrodes. As a result, the output voltage of the auxiliary electrode power source 103 is applied to the first group of auxiliary electrodes. The control signal B is brought to its ON state after the control signal A. In response, the driver 102 connected to the second group of auxiliary drivers is turned on, feeding the output voltage of the power source 103 to the second group. In this manner, the output voltage of the power source 103 is sequentially fed to the first group to the third group for the durations of T1–T8, respectively.

Assume that while the control signal A is in ON state, the ejection electrode controller 104 receives a signal indicative of image data on the ejection electrode #105-1 from an image control section, not shown. Then, the controller 104 feeds an ejection electrode control signal D1 to the ejection driver 107 connected to the ejection electrode #105-1 and thereby turns it on (labeled [I]). Consequently, the output voltage of the ejection electrode power source 106 is fed to the first group of ejection electrodes #105-1, #105-16, . . . , #105-106 via the driver 107. Because a particular voltage is applied to each of the auxiliary electrodes 101 and ejection electrode #105-1, an electric field intense enough to eject the toner particles is generated. As a result, a fine mass of particles is ejected from the tip of the ejection electrode 105-1 toward the counter electrode 112 for the duration of T1. The particles deposit on the recording medium and form a dot thereon.

In the above condition, although the other ejection electrodes #105-16, #105-31, . . . , #105-106 are applied with the same voltage as the ejection electrode #105-1, they do not eject the particles because they are not applied with the auxiliary electrode voltage. Specifically. FIG. 12 shows a condition wherein the electrode #105-17 does not eject the particles (labeled (1)), but the electrode #105-113 ejects them for the duration of T1 (labeled [1]).

While the control signal B remains in its ON state for the the duration of T2, the electrode #105-2 (labeled [II]) and electrode #105-17 (labeled (2)) each ejects the particles for the duration of T2, but the electrode #105-113 (labeled [2]) does not eject them. Further, while the control signal H is in its ON state for the duration of T8, the electrode #105-8 (labeled [III]) and electrode #105-120 (labeled [8]) each ejects the particles for T8, but the electrode #105-33 (labeled (8)) does not eject them.

As stated above, each ejection electrode ejects the toner particles only when it and its associated auxiliary electrodes each is applied with a particular voltage. In the illustrative embodiment, in each eight-element head unit, the ejection heads #105-1 and #105-8 eject the particles for a period of time longer than the default value while the ejection head #105-3 ejects them for a period of time shorter than the default value. This successfully makes up for the scatter among the ejection electrodes and thereby guarantees substantially the same amount of ejection from all of the ejection electrodes 105.

4th Embodiment

A fourth embodiment of the present invention will be described with reference to FIG. 13. This embodiment is identical with the third embodiment as to the configuration of the electrodes. In this embodiment, a particular voltage is applied to each of the auxiliary electrode group, and a voltage controller 301 is substituted for the voltage duration contrdller 110. The voltage controller 301 uses the fact that the intensity of electric field and therefore the amount of toner particles to be ejected increases with an increase in voltage.

Figure 13:
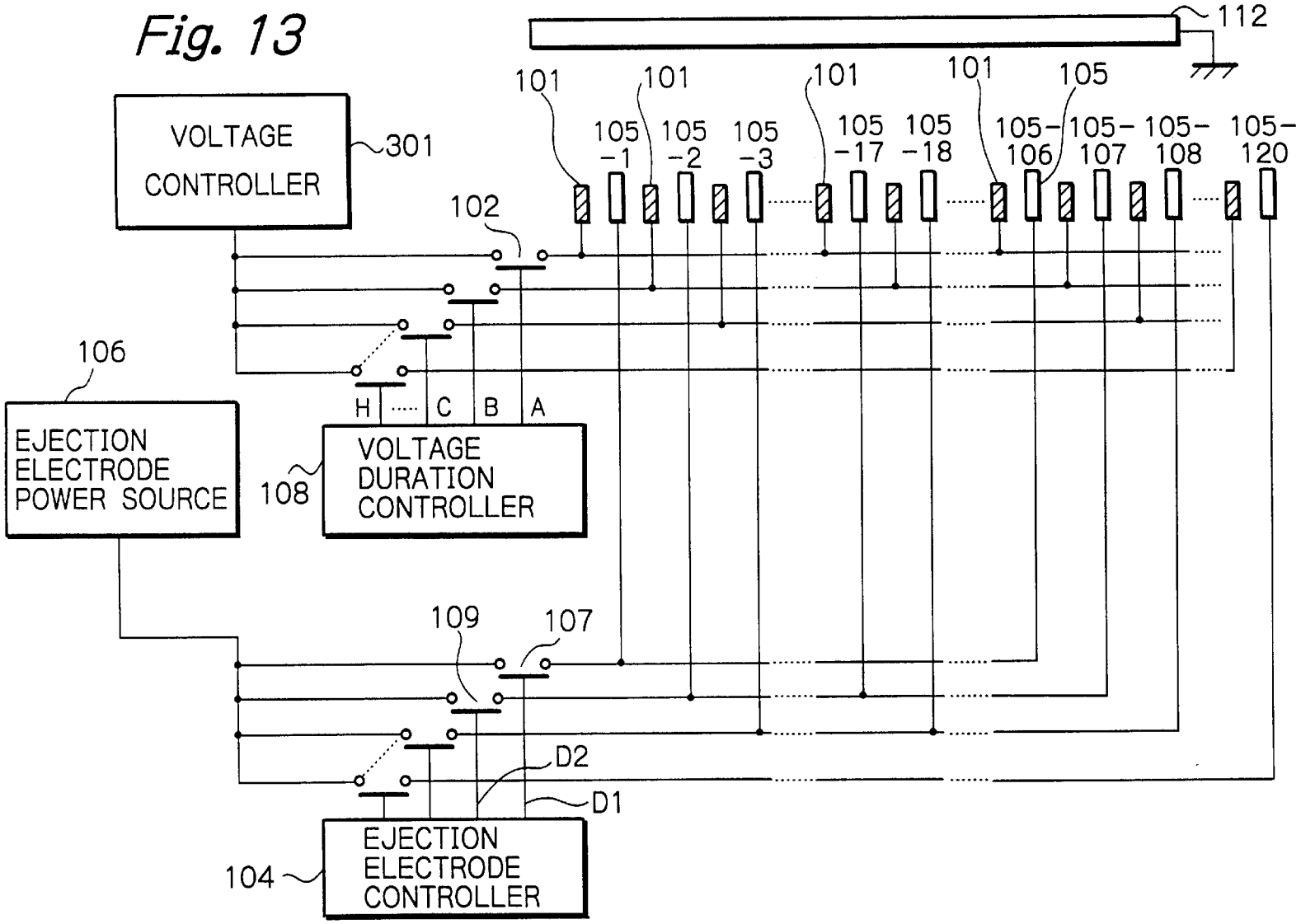
FIG. 13 shows control means representative of a fourth embodiment of the present invention.

Specifically, as shown in FIG. 13, a voltage lower than a default value is assigned to the first and eighth groups of auxiliary electrodes 101 while a voltage higher than the default value is assigned to the third group of auxiliary electrodes 101. In this condition, the potential difference is greatest between the ejection electrodes and the auxiliary electrodes corresponding to each of the first and eighth auxiliary electrode groups, intensifying the electric fields around the ejection ports. By contrast, the above potential difference is smallest between the ejection electrodes and the auxiliary electrodes corresponding to the third auxiliary electrode group, slightly weakening the electric fields around the ejection ports. This successfully sets up a substantially uniform electric field distribution throughout the groups and thereby substantially uniforms the amount of particles to be ejected.

As stated above, in the third and fourth embodiments, the duration of a voltage to be applied to the auxiliary electrodes or the voltage itself is varied in order to vary the amount of toner particles to be ejected on an ejection electrode basis. With this scheme, it is possible to absorb a scatter among heads ascribable to the production process and therefore to allow all the ejection electrodes to eject substantially the same amount of toner particles.

Various modifications will become possible for those skilled in the art after receiving the teachings of the present disclosure without departing from the scope thereof.

What is claimed is:

1. An electrostatic ink jet recorder for recording an image on a recording medium by applying an electric field to ink containing charged toner particles and ejecting an ink drop based on a Coulomb force acting on said toner particles, said electrostatic ink jet recorder comprising:

an electrophoresis electrode for causing the toner particles to concentrate at ejection ports;

a plurality of ejection electrodes each for ejecting the toner particles concentrating at a particular one of said ejection ports;

a counter electrode facing said ejection ports with the intermediary of the recording medium; and a plurality of auxiliary electrodes adjoining said plurality of ejection electrodes for intensifying electric fields;

said plurality of ejection electrodes being divided into a plurality of first groups and applied with a voltage group by group, said plurality of auxiliary electrodes being divided into a plurality of second groups and applied with a voltage group by group, wherein one of said first groups contains at least two of said ejection electrodes, and one of said second groups contains at least two of said auxiliary electrodes.

2. A recorder as claimed in claim 1, wherein each of said second groups is constituted by n consecutive ones of said auxiliary electrodes, and each of said first groups is constituted by said ejection electrodes located at every position n.

3. A recorder as claimed in claim 1, wherein each of said first groups is constituted by n consecutive ones of said ejection electrodes, and each of said second groups is constituted by said auxiliary electrodes located at every position n.

4. An electrostatic ink jet recorder for recording an image on a recording medium by applying an electric field to ink containing charged toner particles and ejecting an ink drop based on a Coulomb force acting on said toner particles, said electrostatic ink jet recorder comprising:

an electrophoresis electrode for causing the toner particles to concentrate at ejection ports;

a plurality of ejection electrodes each for ejecting the toner particles concentrating at a particular one of said ejection ports, said plurality of ejection electrodes being divided into a plurality of first groups;

a counter electrode facing said ejection ports with the intermediary of the recording medium;

a plurality of auxiliary electrodes adjoining said plurality of ejection electrodes for intensifying electric fields, said plurality of auxiliary electrodes being divided into a plurality of second groups;

a plurality of ejection drivers each for applying a voltage to a particular ejection electrode group;

an ejection electrode controller for controlling said plurality of ejection drivers;

a plurality of auxiliary drivers each for applying a voltage to a particular auxiliary electrode group; and an auxiliary electrode controller for controlling said plurality of auxiliary drivers, wherein one of said first groups contains at least two of said ejection electrodes, and one of said second groups contains at least two of said auxiliary electrodes.

5. A recorder as claimed in claim 4, wherein a single recording period for ejecting the toner particles is divided with respect to time, said ejection electrode controller and said auxiliary electrode controller each executing control in synchronism with consecutive divided timings of the single recording period, said ejection electrode controller and said auxiliary electrode controller being combined for control.

6. A recorder as claimed in claim 4, wherein each of said second groups is constituted by n consecutive ones of said auxiliary electrodes, and each of said first groups is constituted by said ejection electrodes located at every position n.

7. A recorder as claimed in claim 4, wherein each of said first groups is constituted by n consecutive ones of said ejection electrodes, and each of said second groups is constituted by said auxiliary electrodes located at every position n.

8. An electrostatic ink jet recorder for recording an image on a recording medium by applying an electric field to ink containing charged toner particles and ejecting an ink drop based on a Coulomb force acting on said toner particles, said electrostatic ink jet recorder comprising:

an electrophoresis electrode for causing the toner particles to concentrate at ejection ports:

a plurality of ejection electrodes each for ejecting the toner particles concentrating at a particular one of said ejection ports;

a counter electrode facing said ejection ports with the intermediary of the recording medium; and a plurality of auxiliary electrodes adjoining said plurality of ejection electrodes for intensifying electric fields wherein and said plurality of ejection electrodes as divided into first groups, at least one of said first groups having at least two of said auxiliary electrodes, and said plurality of auxiliary electrodes is divided into second groups, at least one of said second groups having at least two of said auxiliary electrodes.

9. A recorder as claimed in claim 8, wherein each of said second groups is applied with a voltage for a particular period of time.

10. A recorder as claimed in claim 8, wherein each of said second groups is applied with a particular voltage.

11. A recorder as claimed in claim 10, wherein the voltage is applied to each of said second groups for a particular period of time, and each of said ejection electrodes is applied with a voltage for a particular period of time.

12. A recorder as claimed in claim 8, further comprising:

an ejection electrode controller for dividing said ejection electrodes into a plurality of said first groups to thereby control said ejection electrodes on a group basis;

an auxiliary electrode controller for dividing said auxiliary electrodes into a plurality of said second groups to thereby control said auxiliary electrodes on a group basis; and a voltage duration controller for assigning a particular duration of voltage application to each of said second said plurality of groups of said auxiliary electrodes.

13. A recorder as claimed in claim 8, further comprising:

an ejection electrode controller for dividing said ejection electrodes into a plurality of said first groups to thereby control said ejection electrodes on a group basis; and a voltage controller for applying a particular voltage to each of said second groups of said auxiliary electrodes.

14. A recorder as claimed in claim 13, further comprising an auxiliary electrode controller for dividing said auxiliary electrodes into a plurality of said second groups and applying a voltage to each of said plurality of said second groups for a particular period of time.

* * * * *